US005094205A

United States Patent [19]

Billheimer

[11] Patent Number: 5,094,205

[45] Date of Patent: Mar. 10, 1992

[54] SCROLL-TYPE ENGINE

[76] Inventor: James C. Billheimer, R.R. 3, Box 302, Nashville, Ind. 47448

[21] Appl. No.: 428,779

[22] Filed: Oct. 30, 1989

[51] Int. Cl.[5] ..... F02B 53/00

[52] U.S. Cl. ..... 123/235; 418/55.3; 418/60; 123/234

[58] Field of Search ..... 123/235, 234; 418/55.3, 418/60, 188

[56] References Cited

U.S. PATENT DOCUMENTS

| | | | |
|---|---|---|---|
| 801,182 | 10/1905 | Creux . | |
| 1,877,250 | 9/1932 | Meyer . | |
| 2,231,440 | 2/1941 | Fess . | |
| 2,475,247 | 7/1949 | Mikulasek | 418/55.3 X |
| 3,817,664 | 6/1974 | Bennett et al. . | |
| 3,884,599 | 5/1975 | Young et al. . | |
| 3,964,442 | 6/1976 | Hunter | 418/61.1 X |
| 3,994,635 | 11/1976 | McCullough . | |
| 3,994,636 | 11/1976 | McCullough et al. . | |
| 4,129,405 | 12/1978 | McCullough . | |
| 4,192,152 | 3/1980 | Armstrong et al. . | |
| 4,300,875 | 11/1981 | Fischer et al. . | |
| 4,343,599 | 8/1982 | Kousokabe . | |
| 4,484,869 | 11/1984 | Nakayama et al. . | |
| 4,490,099 | 12/1984 | Terauchi et al. . | |
| 4,497,615 | 2/1985 | Griffith . | |
| 4,505,651 | 3/1985 | Terauchi et al. . | |
| 4,515,539 | 5/1985 | Morishita . | |
| 4,550,480 | 11/1985 | Tanikawa et al. . | |
| 4,553,913 | 11/1985 | Morishita et al. . | |
| 4,677,949 | 7/1987 | Youtie . | |
| 4,824,343 | 4/1989 | Nakamura et al. . | |
| 4,824,344 | 4/1989 | Kimura et al. . | |
| 4,824,345 | 4/1989 | Fukuhara et al. . | |
| 4,824,346 | 4/1989 | Hiraga et al. . | |
| 4,886,434 | 12/1989 | Satow et al. . | |

FOREIGN PATENT DOCUMENTS

| | | | |
|---|---|---|---|
| 813559 | 3/1937 | France | 418/55.3 |
| 26203 | 2/1982 | Japan | 418/55.3 |
| 76202 | 5/1982 | Japan | 418/60 |
| 78494 | 4/1987 | Japan | 418/55.3 |

*Primary Examiner*—Michael Koczo
*Attorney, Agent, or Firm*—Barnes & Thornburg

[57] ABSTRACT

A scroll-type engine includes an orbiting member situated inside the interior volume of the engine to define a compression chamber and an expansion chamber. The orbiting member includes an aperture for transferring an air and fuel mixture from the compression chamber to the expansion chamber. A spiral wrap found on a first stator of the engine provides a valve for controlling flow through the aperture in response to movement of the orbiting member relative to the first stator. A drive post is coupled to the first stator for rotation about its longitudinal axis. A drive pin formed on the orbiting member engages the drive post to rotate the drive post about its longitudinal axis in response to movement of the orbiting member relative to the first stator. The engine also includes a mechanism for converting rotational movement of the drive post to rotational movement of a crank shaft of the engine.

30 Claims, 3 Drawing Sheets

SCROLL-TYPE ENGINE

BACKGROUND AND SUMMARY OF THE INVENTION

The present invention relates to a scroll-type internal combustion engine for rotating a shaft. More particularly, the present invention relates to an engine having a single orbiting member situated inside an interior volume of the engine to divide the interior volume into a compression chamber for compressing an air and fuel mixture and an expansion chamber for expanding combustion products formed when the air and fuel mixture is ignited. The orbiting member includes an orbiting member plate which is formed to include the aperture means for conducting the air and fuel mixture between the compression and expansion chambers. Valve means is situated on a first stator of the engine to cover the aperture means periodically to regulate flow of the air and fuel mixture in response to movement of the orbiting member with respect to the first stator.

Various types of scroll-type devices are used as fluid pumps, fluid compressors, and as motors or engines to drive crank shafts. It is well known in the art to provide scroll-type engines which include only a single orbiting member that both compresses inlet air and expands combustion products to provide a power take-off for rotating an external crank shaft. See, for example, U.S. Pat. No. 4,677,949 to Youtie et al.

One object of the present invention is to provide a device which is easy to manufacture by designing components which require mating surfaces that may be cast and have the mating surfaces lapped together to achieve a mating seal.

Another object of the present invention is to provide a device having a reliable built-in valving or fluid flow mechanism.

Yet another object of the present invention is to provide a device which utilizes a simple means of transmitting orbiting motion to rotary motion.

Still another object of the present invention is to provide a device which utilizes the energy of centrifugal moment to achieve compression and is not dependent on shaft action for same.

A further object of the present invention is to provide an economical and reliable fuel flow regulating mechanism for a scroll-type engine to simplify manufacture and maintenance of the engine.

According to the present invention, a scroll-type engine for rotating a shaft about an axis of rotation comprises a first stator and a second stator coupled to the first stator to define an interior volume therebetween. An orbiting member is disposed in the interior volume for movement therein. An elongated drive post having a longitudinal axis is seated in the first stator to support the drive post for rotation about its longitudinal axis with respect to the first stator. The engine further includes means on the orbiting member for rotating the drive post about its longitudinal axis and means interconnecting the drive post and the shaft for converting rotational movement of the drive post to rotational movement of the shaft. Orbiting movement of the oscillator imparts rotary motion to the drive post to rotate the drive post about its longitudinal axis. Therefore, the shaft rotates about its axis of rotation in response to movement of the orbiting member within the interior volume as defined by the stators.

The orbiting member includes an orbiting member plate having upwardly and downwardly facing surfaces. The upwardly facing surface mates with the first stator to define a first closed chamber or compression chamber therebetween for receiving an air and fuel mixture therein. The downwardly facing surface mates with the second stator to define a second closed chamber or expansion chamber therebetween. The orbiting member plate is formed to include a hole or aperture at the center as a passage for conducting the air and fuel mixture between the compression and expansion chambers. As the orbiting member goes through its cycle, the aperture formed in the orbiting member plate is moved relative to the first stator so that an interior tip and a scroll located on the first stator alternately uncovers and covers the aperture to open and close the aperture, respectively. Essentially, the scroll on the first stator functions as a valve to control the flow of air and fuel between the compression chamber and the expansion chamber through the aperture formed in the orbiting member plate. This valve action starts and ends both the compression and expansion cycles.

One feature of the present invention is the provision of a scroll-type engine having an orbiting member formed to include aperture means for passing a compressed fuel mixture directly from the compression chamber to the expansion chamber for ignition to provide a power source for rotating the shaft. The engine also includes valve means on the first stator for periodically closing the aperture means to block transfer of the fuel mixture between the compression and expansion chamber in response to movement of the orbiting member to a predetermined position relative to the first stator. Advantageously, such a configuration provides a reliable fuel flow regulating construction which is easy to manufacture and requires less maintenance than conventional scroll-type engines. The present invention does not rely on a fuel injector or the like to add fuel to compressed air in the expansion chamber prior to ignition of the fuel.

Another feature of the present invention is the provision of a drive post coupled to the first stator to extend into the interior volume of the engine. The drive post includes a head portion formed to include an inner wall shaped to define a radially outwardly extending slot. A first portion of the inner wall provides a drive wall for rotating the drive post. A drive pin coupled to the orbiting member is positioned to contact the drive wall to rotate the drive post about its longitudinal axis in response to movement of the orbiting member inside the interior volume relative to the first stator. Advantageously, such a configuration permits the drive pin to reciprocate in the slot along a radius of the drive post and slide along the drive wall as the drive pin is moved in an orbit about the longitudinal axis of the drive post by the orbiting member. Therefore, the orbiting member has a range of movement inside the housing in which the orbiting member rotate the drive post. The orbiting member is not limited to a single orbital path by a rigid connection to the power take-off. Therefore, the spiral wraps of the engine can provide sealed pockets for compressing and expanding the fuel mixture even after some wear occurs inside the engine.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

The present invention relates to a scroll-type device for rotating a shaft. The present invention depicts, but is not limited to, an internal combustion engine which uses an orbiting member in lieu of a rotor. The orbiting member moves in an interior volume defined by stators for compressing and expanding. The orbiting member is a plate which has scrolls on both an upper and lower surface. The orbiting member plate has a hole or aperture through the center which serves as a valve opening. The stators ar plates which have scrolls mounted to their surface which are mated with complementary scrolls provided on the orbiting member. The movement of the orbiting member scrolls with respect to the stator scrolls makes the compression, expansion, and the valve action between the compression and expansion chambers of the device. The transmission of orbiting motion into rotary motion is accomplished with drive pins mounted on the scroll of the orbiting member. These drive pins extend through holes in the stators to engage slots in drive posts extending through the first stator. The drive posts are connected together by a gear box. Centrifugal movement of the orbiting member moving in a circular or orbital motion provides the energy and movement required for compression. The drive pins engaging the drive posts maintain the true position of the orbiting member with regard to the stators.

Figure 1:
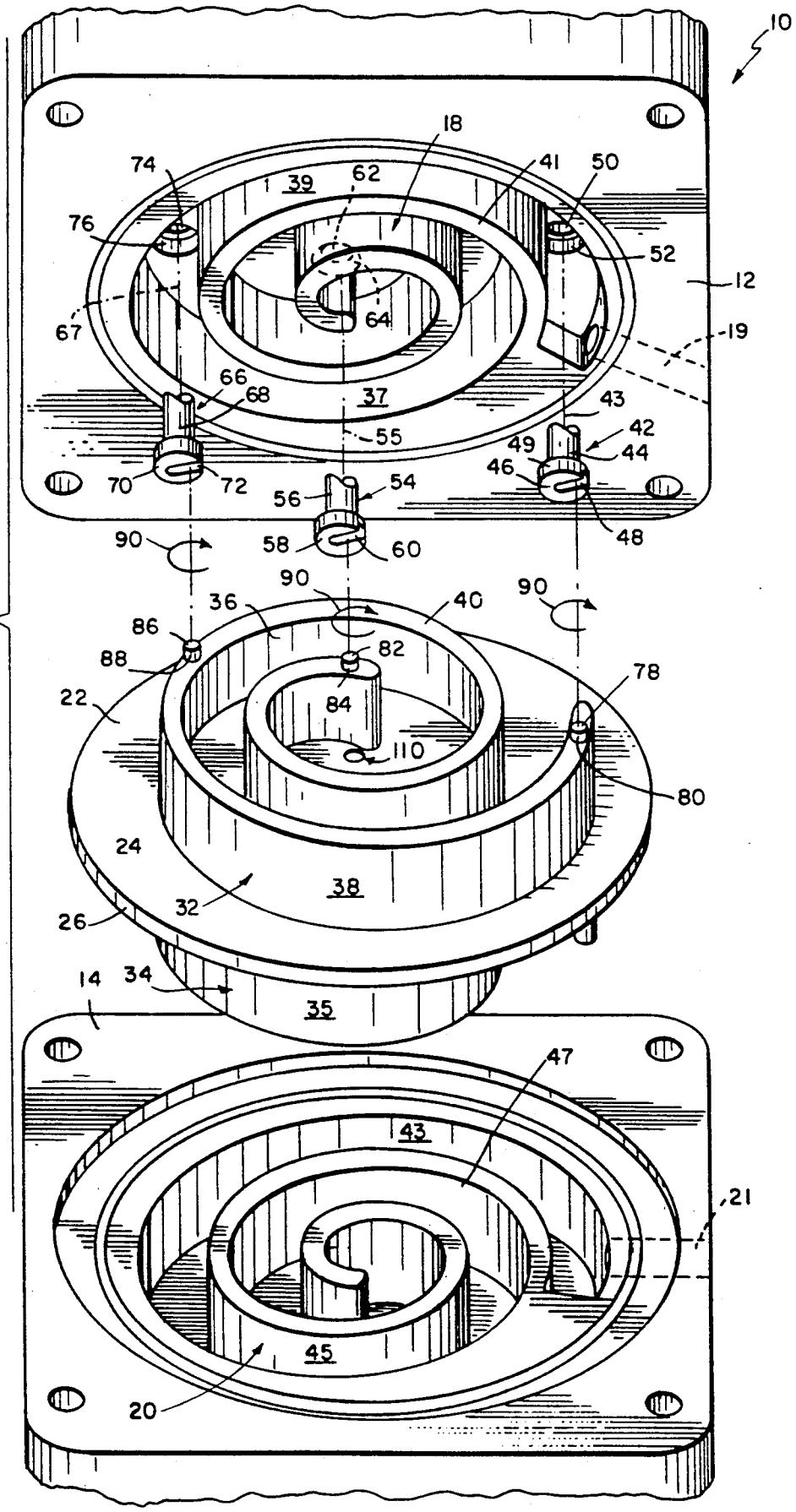
FIG. 1 is an exploded perspective view of a preferred embodiment of a scroll-type engine in accordance with the present invention showing an orbiting member receivable in an interior region formed upon connection of a compression-side stator to an expansion-side stator.
Figure 2:
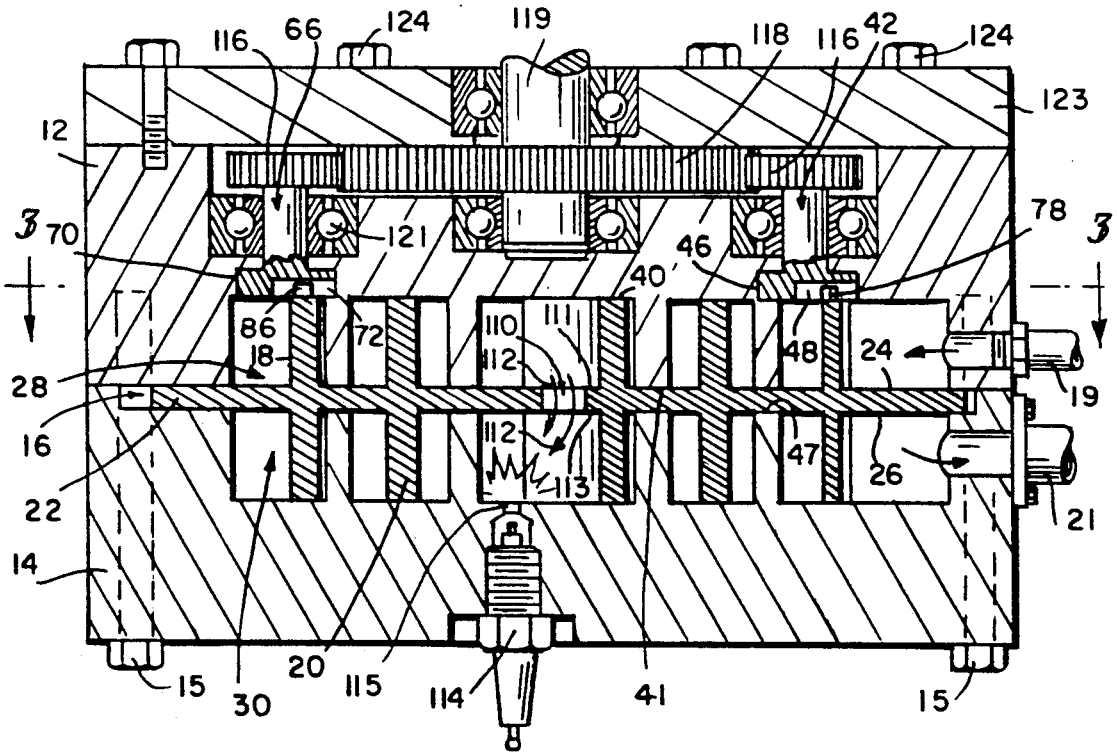
FIG. 2 is a sectional view of the engine of FIG. 1 after assembly showing ignition of fuel in the expansion chamber by means of a plug to cause the orbiting member to orbit in the interior region between the compression and expansion stators in the engine.

As shown in FIGS. 1 and 2, a scroll-type internal combustion engine 10 includes a first stator 12 and a second stator 14. The first stator 12 and second stator 14 are coupled together to form an interior, volume of the engine 10 therebetween. An orbiting member 16 is situated inside the interior volume of engine 10. First stator 12, second stator 14, and orbiting member 16 may be manufactured from aluminum, steel, ceramic, or any other suitable material.

The orbiting member 16 is capable of movement inside the interior volume. The orbiting member 16 includes an orbiting member plate 22 having an upwardly facing surface 24 and a downwardly facing surface 26. The upwardly facing surface 24 mates with the first stator 12 to define a first closed chamber 28 which provides the compression chamber of engine 10 for receiving an air and fuel mixture through inlet 19. Downwardly facing surface 26 mates with the second stator 14 to define a second closed chamber 30 which provides the expansion chamber of the engine 10.

A compression spiral wrap 18 is mounted on the first stator 12 to lie in the first closed chamber 28 and to project in an axially downward direction toward upwardly facing surface 24 of plate 22. Compression spiral wrap 18 includes an inner wall 37, an outer wall 39, and a bottom wall 41. A first spiral wrap 32 is mounted on the upwardly facing surface 24 of orbiting member plate 22 and extends in an axially upward direction toward the first stator 12. The first spiral wrap 32 includes an inner wall 36, an outer wall 38, and a top wall 40. Inner wall 36 and outer wall 38 of the first spiral wrap 32 engage outer wall 39 and inner wall 37, respectively, of compression spiral wrap 18 to provide at least one closed pocket inside the first closed chamber 28 which moves spirally and radially inward and reduces in size in response to movement of orbiting member 16 relative to the first stator 12 in a clockwise direction in the views shown in FIGS. 3 and 4.

The engine 10 also includes an expansion spiral wrap 20 mounted on second stator 14 to lie in the second closed chamber 30 and project in an axially upward direction toward the-downwardly facing surface 26 of orbiting member plate 22. Expansion spiral wrap 20 includes an inner wall 43, an outer wall 45, and a top wall 47. A second spiral wrap 34 of orbiting member 16 is mounted on the downwardly facing surface 26 of orbiting member plate 22 to lie in the second closed chamber 30 and to project in an axially downward direction toward the second stator 14. An inner wall (not shown) and an outer wall 35 of the second spiral wrap 34 engage outer wall 45 and inner wall 43, respectively, of expansion spiral wrap 20 to provide at least one closed pocket which moves spirally and radially outward and expands in size to expand combustion products of the engine upon ignition of the air and fuel mixture in second closed chamber 30 in response to movement of the orbiting member 16 relative to the second stator 14 in a clockwise direction in the views shown in FIGS. 3 and 4.

Three drive posts 42, 54, and 66 are coupled to the first stator 12 to support the drive posts 42, 54, and 66 for rotation about their longitudinal axes 43, 55, and 67, respectively. Drive post 42 includes a drive shaft 44 and a head portion 46. Drive post 42 is rotatably coupled to the first stator 12 by an aperture 50. Aperture 50 is defined by an inner wall 52 formed in the first stator 12. Inner wall 52 provides bearing means for engaging the drive shaft 44 of drive post 42. Head portion 46 of drive post 42 is formed to include a radially outwardly opening slot 48.

Drive post 54 is coupled to first stator 12 by aperture 62 defined by inner wall 64. Inner wall 64 provides a bearing means for drive shaft 56 of drive post 54. Drive post 54 also includes a head portion 58 having a radially outwardly opening slot 60.

Drive post 66 is coupled to first stator 12 by aperture 74 defined by inner wall 76. Inner wall 76 Provides bearing means for drive shaft 68. Drive post 66 includes a head portion 70 having a radially outwardly opening slot 72.

The first spiral wrap 32 of orbiting member 16 includes three drive pins 78, 82, and 86 mounted on top wall 40 for engaging the drive posts 42, 54, and 66, respectively. Drive posts 48, 54, and 66 rotate in the direction of arrows 90 about their longitudinal axes 43, 55, and 67, respectively, in response to movement of the orbiting member 16 with respect to the first stator 12 inside the interior volume of engine 10.

Figure 5:
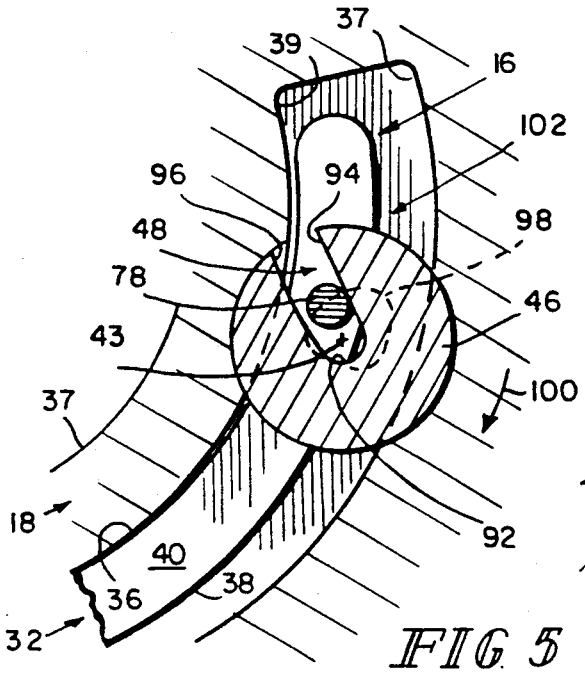
FIG. 5 is a sectional view taken through a portion of FIG. 2 illustrating the position of a drive pin situated on the drive.. Post the first spiral wrap of the orbiting member as the drive pin engages a drive wall of the drive post in an orientation similar to that shown in FIG. 3.
Figure 6:
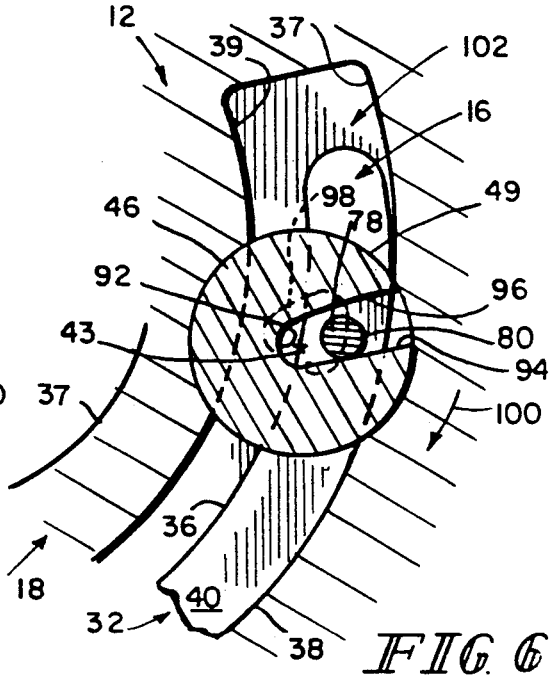
FIG. 6 is a sectional view similar to FIG. 5 in which the orbiting member has moved with respect to the spiral wrap on the first stator to the position shown in FIG. 4 to rotate the drive post about its longitudinal axis to drive the shaft.

Operation of the drive mechanism of the engine is illustrated in FIGS. 5 and 6. While FIGS. 5 and 6 show only operation of drive post 42, it will be understood that drive posts 54 and 66 operate in substantially the same fashion. Slot 48 in head portion 46 of drive post 42 has a closed end 92 adjacent to the longitudinal axis 43 and an open mouth in the exterior side wall 49 of the head portion 46. A drive wall 94 extends between the closed end 92 and the open mouth. Drive pin 78 engages the drive wall 94 to rotate the drive post 42. A trailing wall 96 is situated in spaced-apart relation from drive wall 94 to hold drive pin 78 in at least loose engagement with the drive wall 94.

As orbiting member 16 moves inside the interior volume of engine 10, drive pin 78 moves clockwise (FIGS. 5 and 6) in an orbital path 98 around the longitudinal axis 43 of drive 42. The X and Y axes of the orbiting member 16 remain mutually parallel to the X and Y axes, respectively, of the first and second stators 12 and 14 during movement of the orbiting member 16 relative to the first and second stators 12 and 14. Side wall 80 of drive pin 78 engages the drive wall 94 to rotate the drive post 42 in the direction of arrow 100 in response to movement of the orbiting member 16 relative to the first stator 12. A channel 102 is formed in first stator 12 between outer wall 39 and inner wall 37 of the spiral wrap 18. Channel 102 permits a range of movement for spiral wrap 32 of orbiting member 16 to limit movement of orbiting member 16 relative to the drive post 42. The channel 102 maintains the drive pin 78 in a spaced-apart relation to longitudinal axis 43 of drive post 42 so that the drive pin 78 is constrained to rotate in an orbit about the longitudinal axis, 43 in response to movement of the orbiting member 16 relative to the first stator 12. The drive pin 78 can reciprocate inside the slot 48 to provide a range of movement for the orbiting member 16 in which the drive pin 78 can rotate the drive post 42. Because the orbiting member 16 is not rigidly connected to the shaft, improved seals are obtained between spiral wraps 18 and 32 and between spiral wraps 20 and 34. A lapping and grinding process can be used so that the first and second spiral wraps 32 and 34 on orbiting member 16 wear into the spiral wraps 18 and 20 on the first and second stators 12 and 14, respectively.

Figure 3:
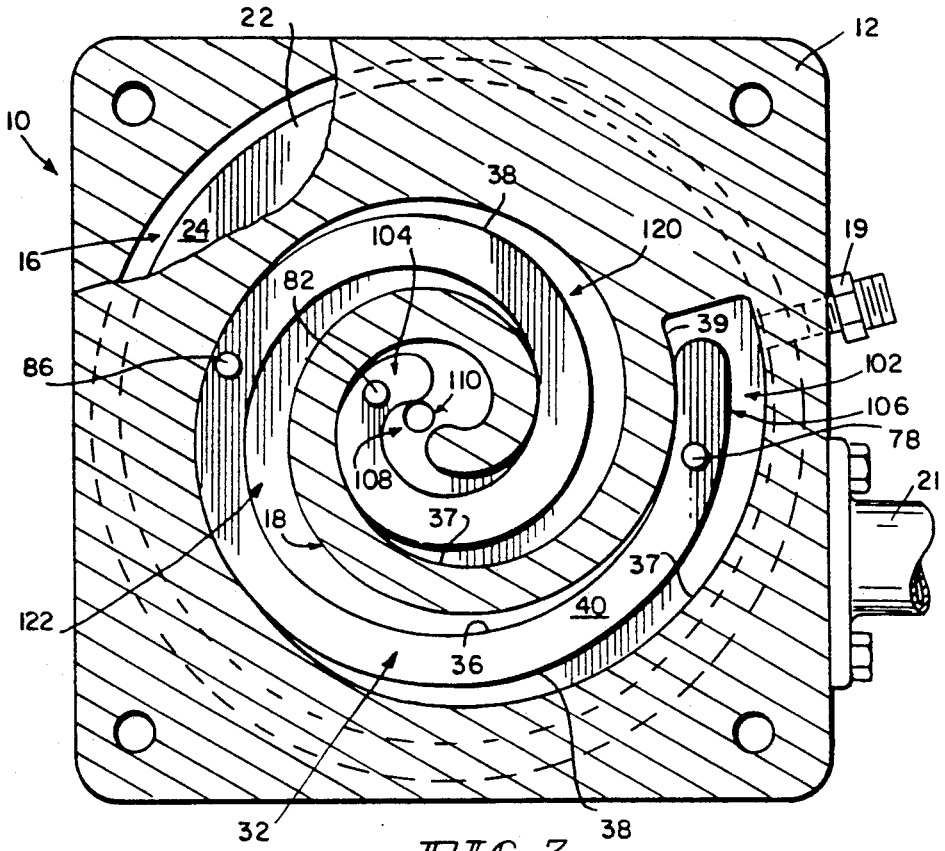
FIG. 3 is a sectional view taken along lines 3—3 of FIG. 2 illustrating operation of the compression spiral wrap and the first spiral wrap of the orbiting member.
Figure 4:
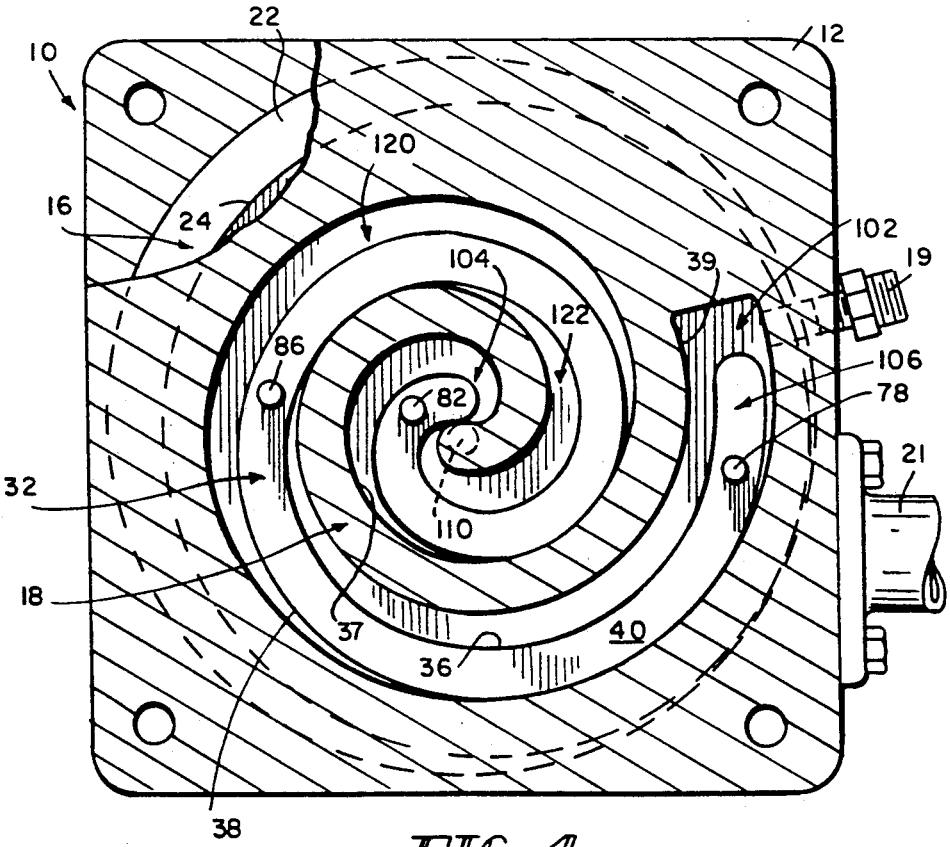
FIG. 4 is a view similar to FIG. 3 in which the orbiting member has moved with respect to the compression spiral wrap to compress the fuel mixture entering the compression chamber.

As shown in FIGS. 3 and 4, spiral wrap 32 of orbiting member 16 includes a radially innermost distal end 104 and a radially outermost distal end 106. Drive pin 78 is situated on spiral wrap 32 in close proximity to the radially outermost distal end 106. Drive pin 82 is situated on spiral wrap 32 in close proximity to the radially innermost distal end 104. Drive pin 86 is situated on spiral wrap 32 intermediate drive pins 78 and 82.

The air and fuel mixture enters channel 102 through inlet 19. As shown in FIG. 3 the air and fuel mixture entering inlet 19 moves between inner wall 37 of spiral wrap 18 and outer wall 38 of first spiral wrap 32. As orbiting member 16 moves relative to the first stator 12 to the position shown in FIG. 4, a closed pocket 120 is formed between inner wall 37 of spiral wrap 18 and outer wall 38 of spiral wrap 32. The air and fuel mixture entering the engine 10 through inlet 19 enters the region between outer wall 39 of spiral wrap 18 and inner wall 36 of spiral wrap 32 when the orbiting member 16 is in the position shown in FIG. 4. The orbiting member 16 then returns to the FIG. 3 position to form a closed pocket 122 between outer wall 39 of spiral wrap 18 and inner wall 36 of spiral wrap 32. Closed pocket 120 moves spirally and radially inward and decreases in size when orbiting member 16 moves from the position shown in FIG. 4 to the Position shown in FIG. 3. Closed pockets 120 and 122 continue to move spirally and radially inward upon orbiting of the orbiting member 16 until they converge at location 108 which is the area of maximum compression.

Aperture 110 communicates with the closed pocket at location 108 when the orbiting member 16 is at the predetermined position shown in FIG. 3. The compressed air and fuel mixture from region 108 passes through the aperture 110 from the first closed chamber 28 to the second closed chamber 30 in the direction of arrows 112 shown in FIG. 2. Aperture 110 includes a top opening 111 on upwardly facing surface 24 of orbiting member plate 22 and a bottom opening 113 on downwardly facing surface 26 of orbiting member plate 22.

After the air and fuel mixture from pocket 108 passes to second closed chamber 30, oscillator 16 moves so that the radially innermost distal end 105 of the spiral wrap 18 of first stator 12 closes aperture 110. As aperture 110 is covered by end 105 the spiral wrap 18 of the first stator 12, spark plug 114 ignites the air and fuel mixture in the second closed chamber 30 to power the engine.

As discussed above, movement of the orbiting member 16 relative to the first stator 12 causes rotation of drive posts 42, 54, and 66. Rotation of drive posts 42, 54, and 66 causes rotation of gears 116 which, in turn, causes rotation of gear 118 which is coupled to shaft 119. Ball bearings 121 facilitate rotation of the drive posts 42, 54, and 66 and shaft 119. Gears 116 and 118 are held in position by an end plate 123 which is coupled t the first stator 12 by suitable fasteners 124.

The first and second stators 12 and 14 and the orbiting member 16 each have mutually perpendicular X and Y axes (not shown). The X and Y axes are mutually orthogonal to the axis of orbiting of orbiting member 16. The X and Y axes of the orbiting member 16 remain mutually parallel to the X and Y axes, respectively, of the first and second stators 12 and 14 during movement of the orbiting member 16 relative to the first and second stators 12 and 14.

Although the invention has been described in detail with reference to a preferred embodiment, variations and modifications exist within the scope and spirit of the invention as described and defined in the following claims.

What is claimed is:

1. A scroll-type engine for rotating a shaft about an axis of rotation, the engine comprising a first stator, a second stator coupled to the first stator to define an interior volume therebetween.

an orbiting member disposed in the interior volume for movement therein to provide means for defining at least one variable volume working chamber between the orbiting member and each of the first and second stators, an elongated drive post having a longitudinal axis, means for coupling the drive post to the first stator to support the drive post for rotation about its longitudinal axis with respect to eh first stator, means interconnecting the drive post and the shaft for converting rotational movement of the drive post about its longitudinal axis to rotational movement of the shaft, and means on the orbiting member for rotating the drive post about its longitudinal axis so that the shaft rotates about its axis of rotation in response to movement of the orbiting member with respect to the first stator in the interior volume, the rotating means including a drive pin coupled to the orbiting member, the drive pin engaging the drive post, the orbiting member including a plate having an upwardly facing surface which mates with the first stator to define a closed chamber therebetween for receiving an air and fuel mixture therein and a spiral wrap mounted on the upwardly facing surface, the drive pin being coupled to the spiral wrap of the orbiting member, the drive post being formed to include a radially outwardly opening slot and the drive pin including a side wall, the drive pin extending away from the orbiting member in an axially upward direction toward the first stator to enter the slot so that the side wall of the drive pin engages a drive wall in the slot to rotate the drive post about its longitudinal axis in response to movement of the orbiting member relative to the first stator.

2. The engine of claim 1, further comprising two auxiliary drive posts, means for coupling each auxiliary drive post to the first stator to support each auxiliary drive post about its own longitudinal axis with respect to the first stator and two auxiliary drive pins coupled to the spiral warp of the orbiting member to provide independent means for rotating each of the two auxiliary drive posts about its longitudinal axis.

3. The engine of claim 2, wherein the spiral wrap of the orbiting member includes a radially innermost distal end and a radially outermost distal end, a first of the drive pins is situated to lie in close proximity to the innermost end, a second of the drive pins is situated to lie in close proximity to the outermost end, and a third of the drive pins is situated to lie on the spiral wrap of the orbiting member in a location intermediate the first and second drive pins.

4. A scroll-type engine for rotating a shaft about its axis of rotation, the engine comprising a first stator, a second stator coupled to the first stator to define an interior volume therebetween, an orbiting member disposed in the interior volume for movement therein to provide means for defining at least one variable volume working chamber between the orbiting member and each of the first and second stators, an elongated drive post having a longitudinal axis and a drive wall, means for coupling the drive post to the first stator to support the drive post for rotation about its longitudinal axis with respect to the first stator, means for rotating the shaft in response to rotation of the drive posts, and means on the orbiting member for engaging the drive wall to rotate the drive post about its longitudinal axis in response to movement of the orbiting member in the interior volume with respect to the first stator so that the shaft is rotated about its axis of rotation by the rotating means to provide a power take-off of the engine, the drive post including a head portion formed to include an inner wall shaped to define a radially outwardly extending slot, a first portion of the inner wall providing a drive wall for rotating the drive post.

5. The engine of claim 4, wherein the engaging means includes a drive pin coupled to the orbiting member and positioned to contact the drive wall to rotate the drive post about its axis of rotation upon movement of the orbiting member inside the interior volume.

6. The engine of claim 5, wherein a second portion of the inner wall of the slot provides a trailing wall situated in spaced-apart opposing relation to the drive wall to hold the drive pin in at least loose engagement with the drive wall.

7. The engine of claim 5, wherein the drive post includes an exterior side wall and is formed to include a radially outwardly extending, pin-receiving slot having a closed end adjacent to the longitudinal axis and an open mouth in the exterior side wall, the drive wall extends between the closed end and the open mouth to provide a side wall of the pin-receiving slot, the engaging means includes a drive pin mounted on the orbiting member to extend into the pin-receiving slot and move in an orbit about the longitudinal axis upon movement of the orbiting member with respect to the first stator, and the drive pin is sized to reciprocate in the pin-receiving slot along a radius of the drive post and slide on the drive wall as the drive pin is moved in its orbit about the longitudinal axis by the orbiting member.

8. The engine of claim 7, wherein the first stator includes means for limiting movement of the orbiting member relative to the drive post to maintain the drive pin in spaced-apart relation to the longitudinal axis of the drive post so that the drive pin is constrained to rotate in an orbit about the longitudinal axis in response to movement of the orbiting member relative to the first stator.

9. A scroll-type engine for rotating a shaft about its axis of rotation, the engine comprising a first stator, a second stator coupled to the first stator to define an interior volume therebetween, an orbiting member disposed in the interior volume for movement therein to provide means for defining at least one variable volume working chamber between the orbiting member and each of the first and second stators, an elongated drive post having a longitudinal axis and a drive wall, the drive post including an inner wall shaped to define a radially outwardly opening slot to provide a drive wall, means for coupling the drive post to the first stator to support the drive post for rotation about its longitudinal axis with respect to the first stator, means for converting rotational movement of the drive post to rotational movement of the shaft, and a drive pin coupled to the orbiting member and configured to engage the drive wall for rotating the drive post about its longitudinal axis in response to movement of the orbiting member with respect to the first stator in the interior volume so that the shaft rotates about its axis of rotation.

10. The engine of claim 9, wherein the drive post includes a head portion formed to include an inner wall shaped to define a radially outwardly extending slot, a first portion of the inner wall providing the drive wall, the drive pin being positioned in the slot for engaging the drive wall.

11. The engine of claim 10, wherein a second portion of the inner wall of the slot provides a trailing wall situated in spaced-apart opposing relation to the drive wall to hold the drive pin in at least loose engagement with the drive wall.

12. The engine of claim 10, further comprising two auxiliary drive posts, means for coupling each auxiliary drive post to the first stator to support each auxiliary drive post about its own longitudinal axis with respect to the first stator and the auxiliary drive pins coupled to the orbiting member to provide independent means for rotating each of the two auxiliary drive posts about its longitudinal axis.

13. The engine of claim 9, wherein the orbiting member includes a plate having an upwardly facing surface which mates with the first stator to define a closed chamber therebetween for receiving an air and fuel mixture therein and a spiral wrap mounted on the upwardly facing surface, and the drive pin is coupled to the spiral wrap of the orbiting member.

14. The engine of claim 13, wherein a first portion of the inner wall provides the drive wall, and the drive pin includes a side wall, the drive pin extends away from the orbiting member in an axially upward direction toward the first stator to enter the slot so that the side wall of the drive pin engages the drive wall in the slot to rotate the drive post about its longitudinal axis in response to movement of the orbiting member relative to the first stator.

15. The engine of claim 13, further comprising two auxiliary drive posts, means for coupling each auxiliary drive post to the first stator to support each auxiliary post about its own longitudinal axis with respect to the first stator and two auxiliary drive pins coupled to the spiral wrap of the orbiting member to provide independent means for rotating each of the two auxiliary drive posts about its longitudinal axis.

16. The engine of claim 15, wherein the spiral wrap of the orbiting member includes a radially innermost distal end and a radially outermost distal end, a first of the drive pins is situated to lie in close proximity to the innermost end, a second of the drive pins is situated to lie in close proximity to the outermost end, and a third of the drive pins is situated to lie on the spiral wrap of the orbiting member in a location intermediate the first and second drive pins.

17. The engine of claim 13, wherein the spiral wrap on the orbiting member includes radially inner and outer side walls, the first stator includes a spiral wrap having radially inner and outer side walls extending downwardly toward the upwardly facing surface of the orbiting member plate, the radially outer wall of the spiral wrap on the first stator cooperating with the radially inner wall of the spiral wrap on the orbiting member plate to define at least one inner closed pocket therebetween, the radially inner side wall of the spiral wrap on the first stator cooperating with the radially outer side wall of the spiral wrap on the orbiting member plate to define at least one outer closed pocket therebetween, the inner and outer closed pockets moving spirally and radially inward and converging inside the closed chamber to compress and pass the air and fuel mixture through a valve formed in the orbiting member.

18. A scroll-type engine for rotating a shaft about an axis of rotation, the engine comprising a first stator, a second stator coupled to the first stator to define an interior volume therebetween, an orbiting member disposed in the interior volume for movement therein, the orbiting member including an orbiting member plate having upwardly and downwardly facing surfaces, the upwardly facing surface mating with the first stator to define a first closed chamber therebetween for receiving an air and fuel mixture therein, the downwardly facing surface mating with the second stator to define a second closed chamber therebetween, the orbiting member plate being formed to include aperture means for conducting the air and fuel mixture between the first and second closed chambers, converting means interconnecting the orbiting member and the shaft for converting movement of the orbiting member in the interior volume to rotational movement of the shaft about its axis of rotation, and valve means on the first stator for periodically closing the aperture means to block transfer of the air and fuel mixture between the first and second closed chambers in response to movement of the orbiting member plate in the interior volume relative to the first stator, the valve means including a spiral wrap mounted on the first stator to lie in the interior volume and project in an axially downward direction toward the upwardly facing surface of the orbiting member plate, the spiral wrap including a bottom wall sidably engaging the upwardly facing surface of the orbiting member plate in mating relation during relative movement of the orbiting member and first stator, and the bottom wall being sized to close the aperture means formed in the orbiting member plate upon movement of the orbiting member plate to a predetermined position relative to the first stator.

19. The engine of claim 18, wherein the converting means comprises an elongated drive post having a longitudinal axis, means for coupling the drive post to the first stator to support the drive post for rotation about its longitudinal axis with respect to the first stator, means interconnecting the drive post and the shaft for converting rotational movement of the drive post about its longitudinal axis to rotational movement of the shaft, and means on the orbiting member for rotating the drive post about its longitudinal axis so that the shaft rotates about its axis of rotation in response to movement of the orbiting member with respect to the first stator in the interior volume.

20. The engine of claim 18, wherein the spiral wrap on the first stator includes a radially inner and a radially outer side wall, the orbiting member plate includes a spiral wrap having a radially inner side wall and a radially outer side wall extending upwardly toward the first stator, the radially outer side wall of the spiral wrap on the first stator cooperating with the radially inner side wall of the spiral wrap on the orbiting member plate to define at least one inner closed pocket therebetween, the radially inner side wall of the spiral wrap on the first stator cooperating with the radially outer wall of the spiral wrap on the orbiting member plate to define at least one outer closed pocket therebetween, the inner and outer closed pockets moving spirally and radially inwardly and reducing in size to compress the air and fuel mixture inside the first closed chamber.

21. The engine of claim 18, further comprising means in the second closed chamber for igniting the air and fuel mixture entering the second closed chamber through the aperture means upon movement of the orbiting member plate to its predetermined position.

22. A scroll-type engine for rotating a shaft about an axis of rotation, the engine comprising a first stator, a second stator coupled to the first stator to define an interior volume therebetween, an orbiting member disposed in the interior volume for movement therein, the orbiting member including an orbiting member plate having upwardly and downwardly facing surfaces, the upwardly facing surface mating with the first stator to define a first closed chamber therebetween for receiving an air and fuel mixture therein, the downwardly facing surface mating with the second stator to define a second closed chamber therebetween, the orbiting member plate being formed to include aperture means for conducting the air and fuel mixture between the first and second closed chamber, converting means interconnecting the orbiting member and the shaft for converting movement of the orbiting member in the interior volume to rotational movement of the shaft about its axis of rotation, and valve means on the first stator for periodically closing the aperture means to block transfer of the air and fuel mixture between the first and second closed chambers in response to movement of the orbiting member plate in the interior volume relative to the first stator, the valve means including a spiral wrap mounted on the first stator to lie in the first closed chamber and project in an axially downward direction toward the upwardly facing surface of the orbiting member plate, the spiral wrap slidably abutting the upwardly facing surface to close the aperture means periodically upon movement of the orbiting member plate to a predetermined position relative to the spiral wrap.

23. The engine of claim 22, further comprising means in the second closed chamber for igniting the air and fuel mixture entering the second closed chamber through the aperture means upon movement of the orbiting member plate to its predetermined position.

24. A scroll-type engine comprising a first stator formed to include a spiral wrap having a predetermined width, a second stator coupled to the first stator to define an interior volume of the engine, and an orbiting member disposed in the interior volume for movement therein to provide means for defining at least one variable volume working chamber between the orbiting member and each of the first and second stators, the orbiting member including a plate having an upwardly facing surface mating with the first stator to define a first closed chamber therebetween for receiving an air and fuel mixture, a downwardly facing surface mating with the second stator to define a second closed chamber therebetween, and a spiral wrap mounted on the upwardly facing surface, the plate being formed to include a port conducting the air and fuel mixture between the first and second closed chambers, the port having dimensions smaller than the width of the spiral wrap of the first stator so that the spiral wrap of the first stator provides a valve for covering the port after the fuel mixture passes from the closed chamber through the port.

25. The engine of claim 24, wherein the spiral wrap of the first stator includes a bottom side wall slidably engaging the upwardly facing surface of the plate in mating relation during relative movement of the orbiting member and the first stator, the bottom wall being sized to cover the port formed in the plate upon movement of the orbiting member to a predetermined position relative to the first stator.

26. The engine of claim 25, further comprising means in the second closed chamber for igniting the fuel mixture entering the second closed chamber through the port upon movement of the orbiting member to its predetermined position.

27. The engine of claim 15, wherein the spiral wrap on the first stator includes a radially inner side wall and a radially outer side wall, the spiral wrap on the orbiting member plate includes a radially inner side wall and a radially outer side wall, the radially outer side wall of the spiral wrap on the first stator cooperating with the radially inner side wall of the spiral wrap on the orbiting member plate to define at least one inner closed pocket therebetween, the radially inner side wall of the spiral wrap on the first stator cooperating with the radially outer side wall of the spiral wrap on the orbiting member plate to define at least one outer closed pocket therebetween, the inner and outer closed pockets moving spirally and radially inward and reducing in size in response to movement of the orbiting member inside the interior volume of the engine to compress the air and fuel mixture, the inner and outer closed pockets converging to pass the compressed air and fuel mixture through the port formed in the orbiting member plate.

28. A scroll-type engine for rotating a shaft about an axis of rotation, the engine comprising, a first stator, a second stator coupled to the first stator to define an interior volume therebetween, an orbiting member disposed in the interior volume for movement therein, the orbiting member including an orbiting member plate having upwardly and downwardly facing surfaces, the upwardly facing surface mating with the first stator to define a first closed chamber therebetween for receiving an air and fuel mixture therein, the downwardly facing surface mating with the second stator to define a second closed chamber therebetween, the orbiting member plate being formed to include aperture means extending between the first and second closed chambers for conducting the air and fuel mixture between the first and second closed chambers, the aperture means including a top opening formed on the upwardly facing surface and a bottom opening formed on the downwardly facing surface, and a spiral wrap mounted on the first stator to die in the first closed chamber and project in an axially downward direction toward the upwardly facing surface of the orbiting member plate, the spiral wrap sliding on the upwardly facing surface to close the top opening of the aperture means periodically during movement of the orbiting member plate relative to the spiral wrap of the first stator.

29. The engine of claim 28, further comprising means for collecting a sample of the air and fuel mixture in a moving closed pocket to achieve maximum compression of the air and fuel mixture in the first closed chamber upon movement of the orbiting member to a predetermined position relative to the first stator, the top opening in the orbiting member communicating with the closed pocket when the oscillator is in the predetermined position.

30. The engine of claim 29, further comprising means in the second closed chamber for igniting the air and fuel mixture entering the second closed chamber through the aperture means upon movement of the orbiting member to its predetermined position.

* * * * *